United States Patent [19]

Hongo

[11] Patent Number: 4,532,792

[45] Date of Patent: Aug. 6, 1985

[54] APPARATUS FOR ADJUSTING TO TOOL LENGTH OF PANEL FORMING MACHINE

[75] Inventor: Toshio Hongo, Ichikawa, Japan

[73] Assignee: Maru Kikai Kogyo Co., Ltd., Japan

[21] Appl. No.: 499,773

[22] Filed: May 31, 1983

[30] Foreign Application Priority Data

Sep. 8, 1982 [JP] Japan ..... 57-136452[U]

[51] Int. Cl.[3] ..... B21D 11/04

[52] U.S. Cl. ..... 72/319; 72/413; 72/481

[58] Field of Search ..... 72/413, 319, 320, 321, 72/322, 323, 481, 482; 269/164

[56] References Cited

U.S. PATENT DOCUMENTS

| | | | |
|---|---|---|---|
| 2,302,958 | 11/1942 | Jensen | 72/319 |
| 2,871,909 | 2/1959 | Bower | 72/321 |
| 3,359,771 | 12/1967 | Meyerchick | 72/319 |
| 4,014,204 | 3/1977 | Hanni et al. | 72/413 |
| 4,089,198 | 5/1978 | Amano et al. | 72/320 |
| 4,112,731 | 9/1978 | Anderson et al. | 72/320 |

FOREIGN PATENT DOCUMENTS

| | | | |
|---|---|---|---|
| 2042509 | 3/1972 | Fed. Rep. of Germany | 72/319 |
| 38263 | 10/1978 | Japan | 72/322 |
| 2032308 | 5/1980 | United Kingdom | 72/319 |

*Primary Examiner*—Daniel C. Crane
*Assistant Examiner*—David B. Jones
*Attorney, Agent, or Firm*—Andrus, Sceales, Starke & Sawall

[57] ABSTRACT

This invention relates to a forming machine which is composed of several types of split dies in an upper die. The length of the upper die is adjusted by changing the combination of the split dies. The upper die assembly has an upper die body mounted on the lower end of a ram. A group of upper split dies are slideably inserted laterally of the die and in the lower portion of the upper die body. A number of upper thin dies are inversely mounted at the center of the upper split die group. A select finger driving mechanism is provided at the front of the upper die body to slide the upper split dies in the lateral direction of the die. An inverting mechanism is provided at the rear of the upper die body to invert the desired number of the upper thin dies and locate them between the split dies to form a die of the desired bending length.

6 Claims, 12 Drawing Figures

APPARATUS FOR ADJUSTING TO TOOL LENGTH OF PANEL FORMING MACHINE

BACKGROUND OF THE INVENTION

1. Field of the Invention

This invention relates to an apparatus for adjusting the tool length of a panel forming machine and, more particularly, to an apparatus for changing a die to alter the effective die width (or the upper die length) of the upper die to the desired bending length for bending a sheet metal plate.

2. Description of the Prior Art

Metal plates, the edge of which is bent in U or Z shape, are employed in a cabinet, a display case, a vending machine, a refrigerator, a panel, a sink, or a switchboard. In order to bend the edge in this shape, the side edges of a sheet metal is ordinarily bent. The sheet metal is then turned in a plane, an upper die is matched to the bent width to the inside of the bent short side of the metal, and the edge of the long side is bent. When the long side of the metal is, for example, bent by a wing bender or press brake, it is necessary to provide a length of the upper die obtained by subtracting the thickness corresponding to two sheets by the length of the long side since there is a rise produced by the previously bent short side. It is further necessary to prepare a number of upper dies of different widths and to change the top tools whenever the width of a work varies, which disadvantageously requires an excessive labor in the exchange. In other words, the length adjustment by resetting the central tools results in long setting time and requires a number of tools of different lengths.

CONVENTIONAL METHOD

For today's requirements, it is very important to provide sheet metal production machines which are suitable for small batch production, having a high flexibility for adaptation to various kinds of components, thereby shortening delivery times and reducing inventories. It is possible with such systems to supply various items according to the incoming orders and according to the requirements of the following welding and assembly stations. In special demand are components of small dimensions, and light weight which are formed with high accuracies such as required by the electronics industry.

SUMMARY OF THE INVENTION

This invention provides a tool length changing device which comprises an upper die body mounted on the lower end of a ram. A group of top tool segments are provided and are slideable in a lateral direction at the lower portion of the top tool body, and a number of inversely thin top tool segments located within the group. A select finger driving mechanism is provided at the front of the top body, for position of the top tool segments and an inverting mechanism is provided for inverting a predetermined number of the thin top tool segments. The top tool segments exceeding the working width are moved outwardly and removed from the working position, and the selective top tool segments are moved by a select finger toward the center and with the inverted thin tool segments form the top tool of the desired width. Thus, the segments are readily and quickly changed.

This quick automatic tool length adjustment is one of the most interesting features of our bending system, based on long years of experience. A required length of the top tool is automatically adjustable by shifting different lengths of tool segments into place by means of a CNC control. The range of automatically adjustable tool length is from 300 mm up to 2400 mm in steps of 5 mm. The tool length adjustment time ranges between 10 to 40 sec. It is therefore possible to incorporate automatic tool length adjustment during a bending sequence. Furthermore, the system has a high flexibility for quick adaptation to different panel sizes. In one embodiment, one set of top tools consists of 22 100 mm-segments, 20 5 mm-segments and 2 shunting pieces of 50 mm, each to reduce the long length for retraction of the finished item. The length is set by combining the required number of 100 mm and 5 mm tool segments. The two shunting pieces of 50 mm are used to retract items with inwards bends.

When all these tool segments are used, the die becomes 2400 mm, the maximum length. When 2 100 mm-segments, 2 50 mm-segments and 0 5 mm-segments are employed the die becomes 300 mm, the minimum width. The tool length can be freely altered between the maximum and the minimum with a control length of 5 mm in width by selecting the combination of the segments. Since the thickness of the sheet metal is ordinarily 1 to 3 mm, the top tool length becomes at a pitch of 2.5 mm at both ends when the upper thin tool is 5 mm in width. Accordingly, this tool can substantially alter the work length in the above described range. In the embodiment disclosed in the drawing, a wing bender is shown as a forming machine, but a wiper bender which has a bending tool rotating and the sheet metal retained on a die by a retaining plate may be used. Further, a punch press brake for bending the metal may be used, with the punch and the die having a V-shaped groove In order to execute the present invention, an automatic front table, not shown, may be installed in a forming machine to accelerate the bending work. In other words, the component is fed onto the table by means of a stacker or conveyor connected with a preceding turret punch press. It is also possible to feed by a robot unit. The plate is then rotated by 90° by means of the rotating device to first locate the small width of the panel in the machine. The panel is automatically fed into position by means of the NC feeding unit. After reaching the correct position, the requiring bends are automatically carried out whereby the plate is automatically moved between bends. After the first edge is bent, the panel is automatically rotated by 180° and positioned for bending the second small side. Afterwards, a rotation of the panel by 90° takes place to position the panel for bending the long side bends. After the first long side is bent, another rotation by 180° locates the second long side for bending. The whole sequence is controlled by means of a CNC circuit which can be programmed in very short time for efficient small batch production.

An object of this invention is to provide an apparatus for rapidly altering a tool length to the specified bending width of a workpiece.

Another object of this invention is to provide a flexible device capable of forming a panel by automating the alternation of the tool.

BRIEF DESCRIPTION OF THE DRAWINGS

A preferred embodiment of the invention—illustrative of the bent mode in which applicants have contemplated applying the principles—is set forth in the following description and shown in the drawings and is particularly and distinctly pointed out and set forth in the appended claims.

DESCRIPTION OF PREFERRED EMBODIMENTS

Figure 1:
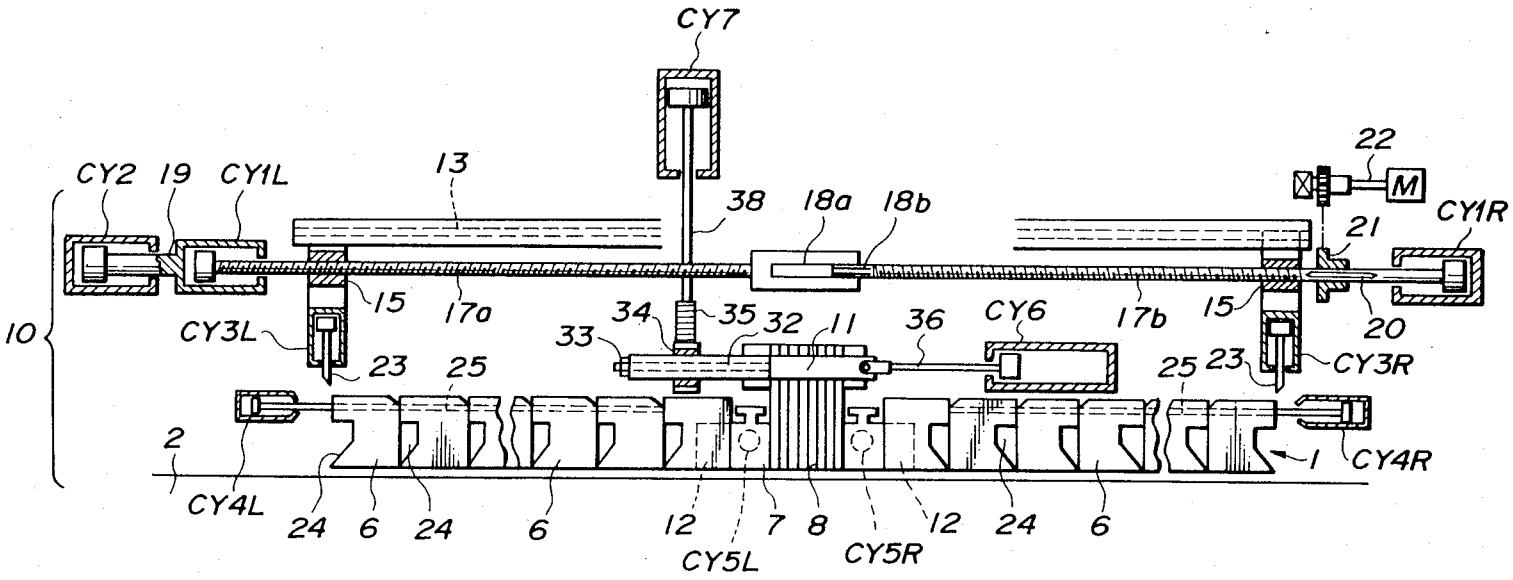
FIG. 1 is a front view of a tool exchanging device applied by a wind bender according to a preferred embodiment of the present invention.
Figure 2:
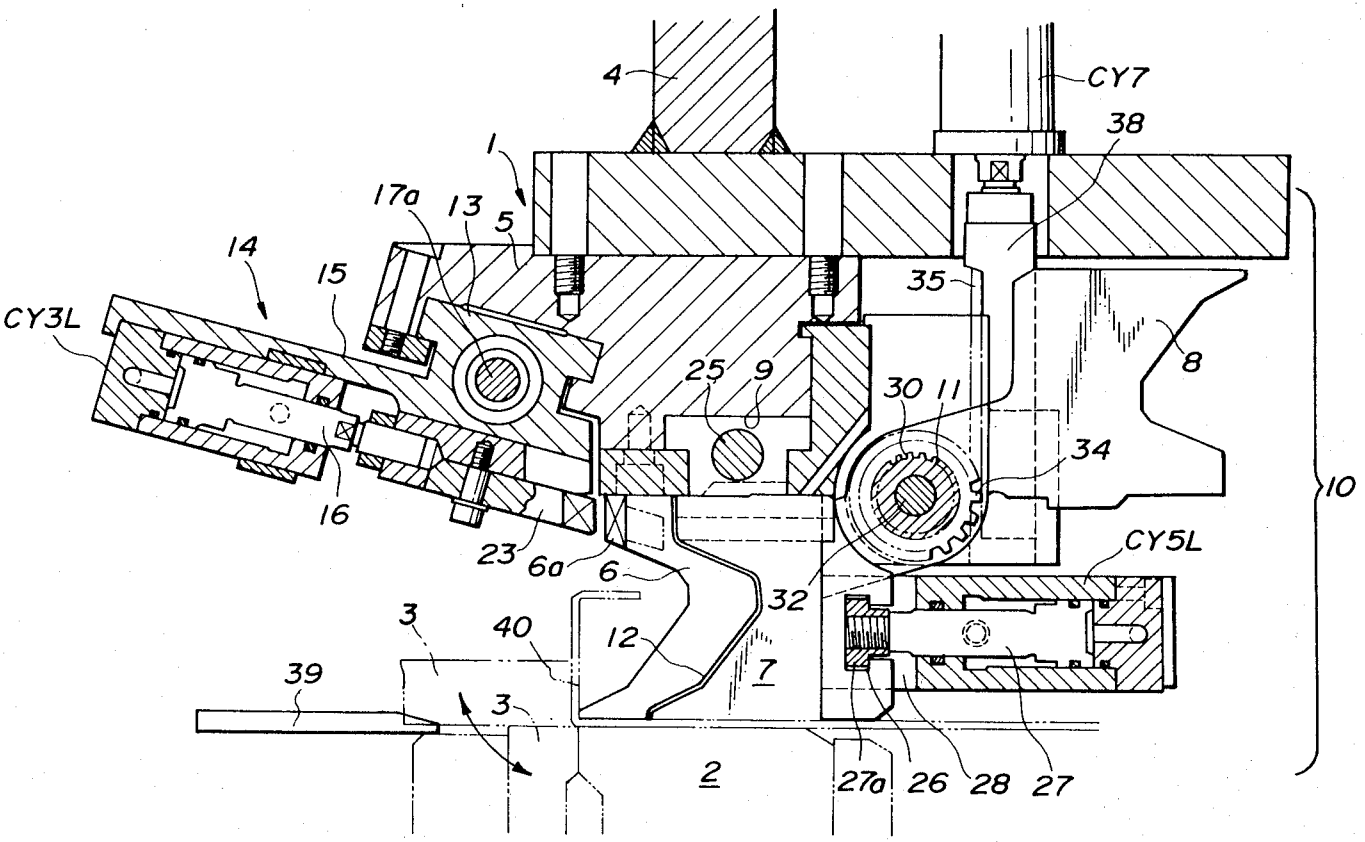
FIG. 2 is an enlarged longitudinal sectional view of the device shown in FIG. 1.

A tool exchanging device is indicated generally at 10, and is shown in assembled state in FIGS. 1 and 2. The essential portion of the device 10 comprises a top tool assembly 1, a bottom 2, and a movable tool 3 which is rotatable 90° or substantially at 90° such as shown in U.S. Pat. No. 4,089,198 which issued May 16, 1978. The assembly 1 comprises a top tool body 5 mounted on the lower end of a ram 4, a group of top tool segments 6 slideably inserted in the lateral direction of the segments 6, a number of thin top tools 8 inversely mounted at the center of the group of the segments 6, and an upper adjustable tool 7 interposed between the segments 6 and the thin tools 8. The movable tool 3 swings from its horizontal position toward the front face of ram 4 in accordance with well known construction such as in the above identified patent.

Figure 5:
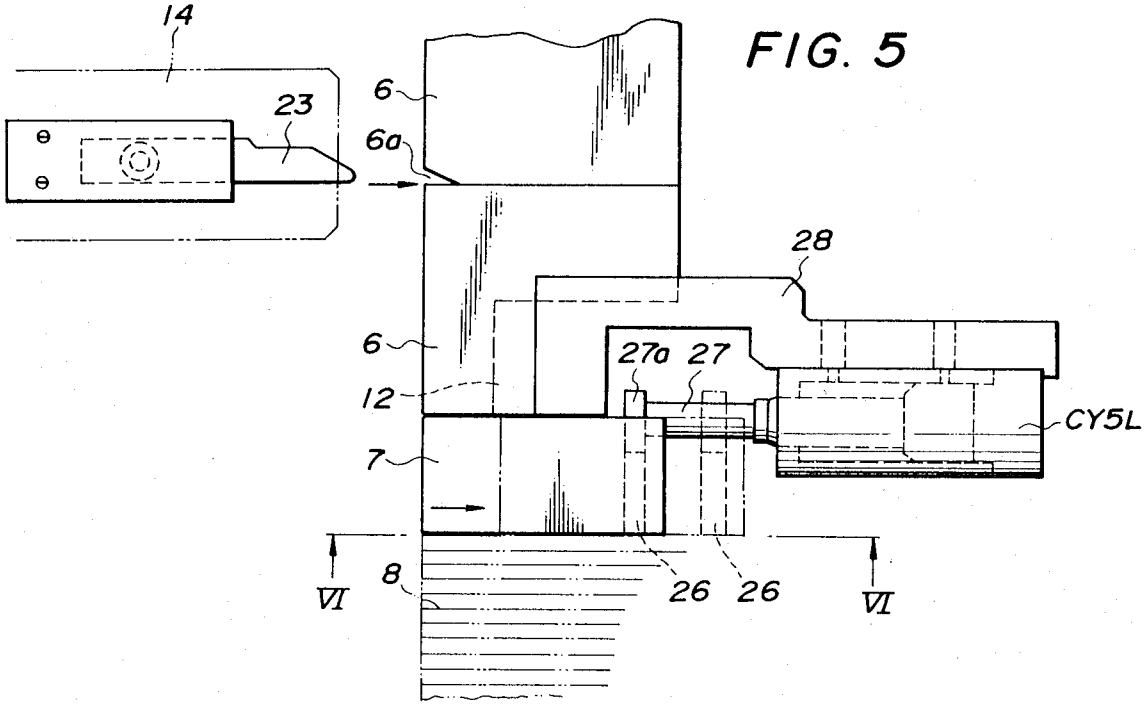
FIG. 5 is a plan view of the mounting portion of an adjusting top tool in FIG. 1.

The segments 6 are inserted into and supported by T-shaped grooves 9 formed on the lower surface of the body 5 and are slideable by a select finger driving mechanism 14, which will be described later. The segments 6 contain, for example, 9 100 mm-segments to each side of the body, for a total of 18 segments, and 5 mm-segments 8 are interposed at the center therebetween. The tools 8 are not inserted into the grooves 9, but are inserted into and supported by a spline shaft 11 which is installed at the rear of the body 5 and extends laterally across the machine. The innermost segment 6 adjacent to segments 8 has a recess 12 at the rear, as shown in FIG. 5, and has a top adjustable tool 7 which telescopes into the recess 12. This tool 7 has ½ of width of the top segments, namely, 50 mm in width.

A second T-shaped groove 13 extending laterally is formed on the front surface of the body 5. A select finger holder 15 is inserted into the groove 13, one to each end thereof. A pair of right and left finger driving mechanisms 14 are mounted to the finger holder 15.

This mechanism 14 comprises, as shown in FIGS. 1 and 2, cylinders CY3L and CY3R mounted on the lower surface of the holder 15, and a finger 23 provided at the end of a piston rod 16.

Each holder 15 of the mechanisms 14 is disposed, as shown in FIG. 1, at the left and right sides, and is threaded on screw rods **17*a* and 17*b*, respectively. Tool pulling cylinders CY1R and CY1L are disposed at the ends of the respective rods 17*a* and 17*b*, and the centers of the rods are coupled via spline cylinders 18*a* and 18*b*, respectively. The cylinder CY1L is coupled to a piston rod 19 of the tool selecting cylinder CY2. A sprocket 21 is supported by a slip key 20 and is mounted on the rod at the right cylinder CY1R. A rotary driving mechanism 22 is coupled to sprocket 21 as shown in FIG. 1. The cylinders CY3L and CY3R are operated to advance a select finger 23, thereby rotating the rods 17*a* and 17*b* in the state engaged with the tapered part 6*a* of the front end of the segment 6. Thus, the top segments contacted with the select finger 23** and a group adjacent to the top segments are simultaneously moved leftwardly or rightwardly.

The segment 6 is formed, as shown in FIG. 1, with side oblique surfaces 24 to prevent interference with a previously bent edge of the sheet metal at both right and left sides. A rod 25 is inserted into the interior of the segments. The end of the rod 25 is fixedly secured to the innermost segment 6, and tool moving cylinders CY4L and CY4R are disposed at the other ends of each rod. These cylinders are operated when the work is removed after the work is bent and the width of the die is again returned to the original value as will be described later.

Figure 6:
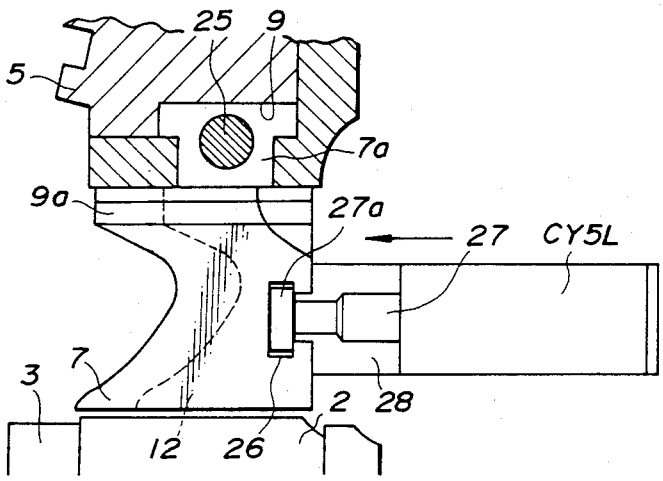
FIG. 6 is a side view as seen along a line VI—VI in a direction of arrows in FIG. 5.

The tool 7 has, as shown in FIGS. 2, 5 and 6, a groove **9*a*, crossing perpendicularly to the groove 9 and formed on the lower surface of piece 7*a* inserted into the groove 9. The tool 7 is inserted into and depended vertically from the groove 9*a*. This tool 7 also has a T-shaped groove 26 extending in the lateral direction of the back surface thereof, and expanded ends 27*a* of the rods 27 of telescoping cylinders CY5L and CY5R are engaged with groove 26. The left cylinder CY5L is fixedly secured to a bracket 28 provided behind the adjacent top segment, and the right cylinder CY5R is fixedly secured to a stationary bracket 29 (in FIG. 5**).

Figure 3:
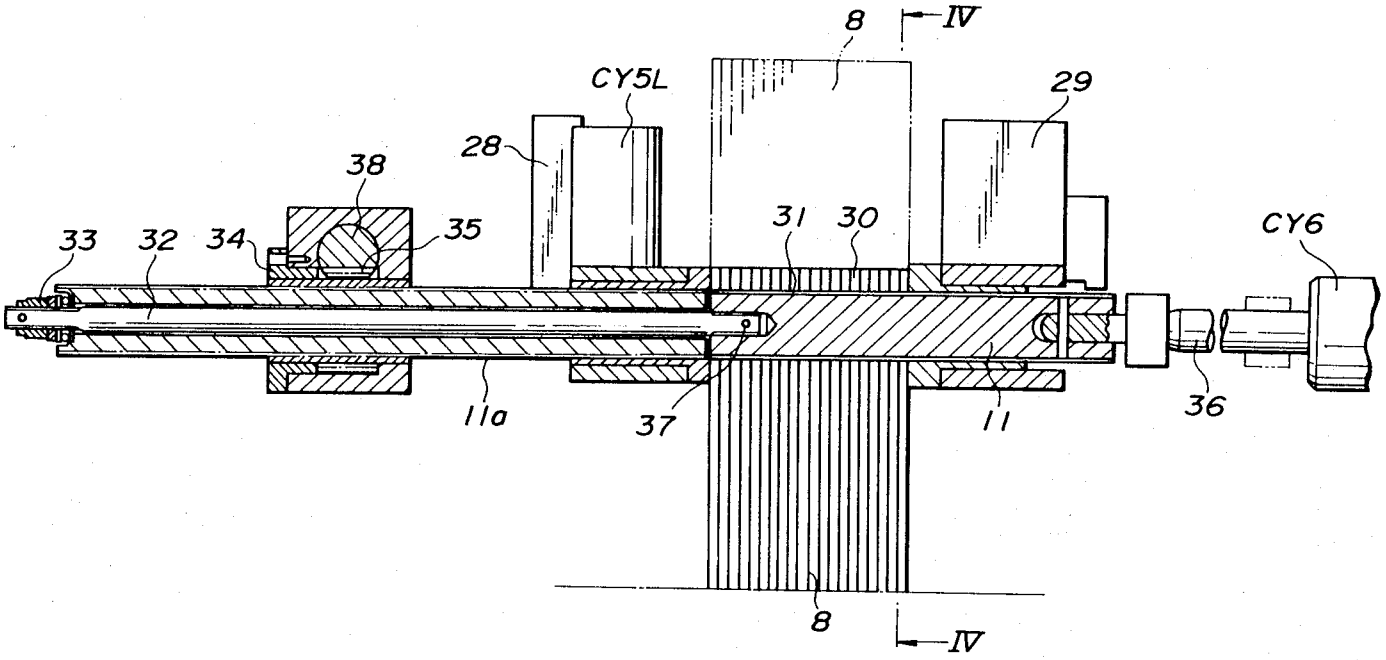
FIG. 3 is an enlarged plan view of an inverting mechanism in FIG. 1.
Figure 4:
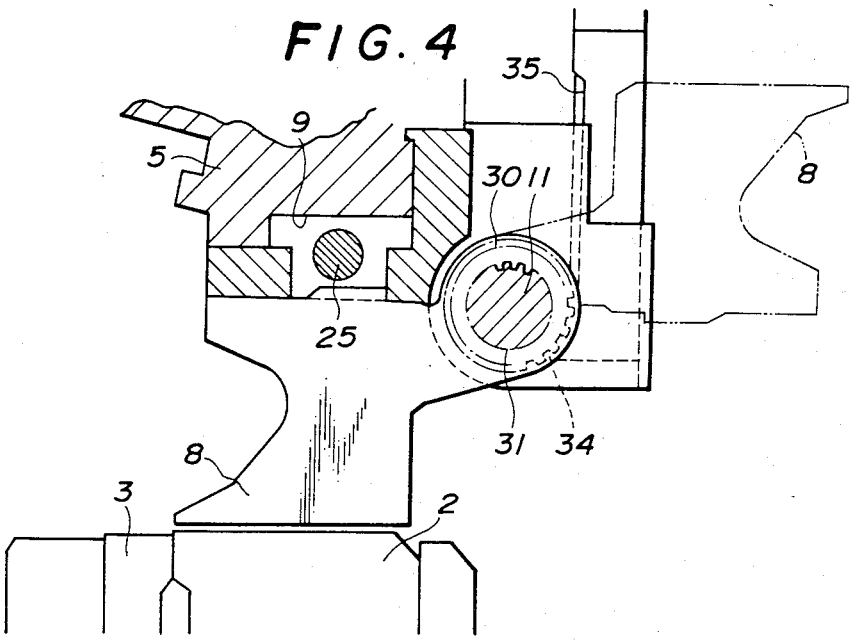
FIG. 4 is a sectional view as seen along a line IV—IV in a direction of arrows in FIG. 3.
Figure 7:
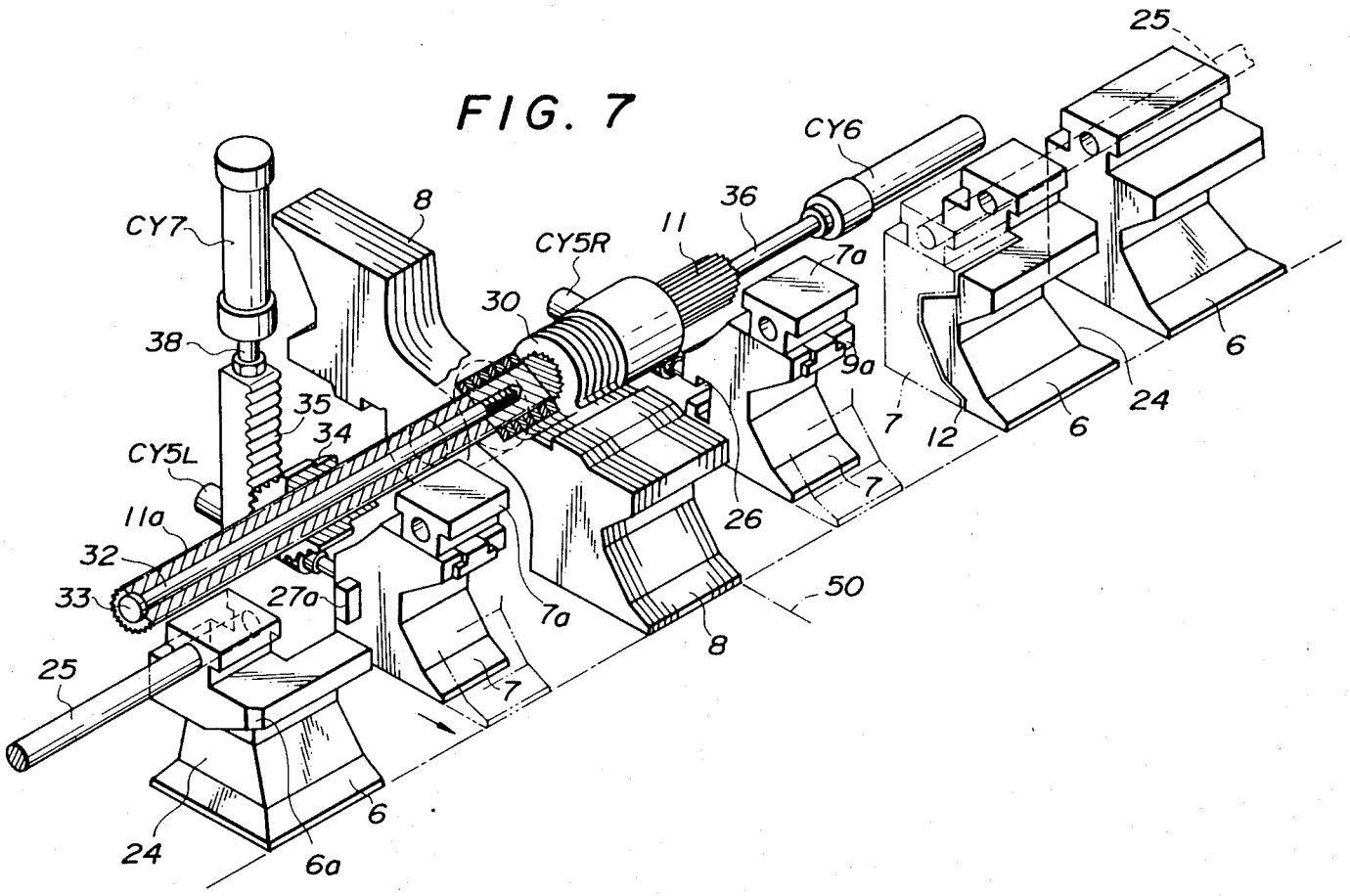
FIG. 7 is an exploded assembling view showing the relationship of top tool segments in the present invention.

The inverting mechanism is shown in FIGS. 1 and 7. The segments 8 are each provided with a spline groove 31 in a circular shape 30 at the upper rear of the tool. The groove 31 is engaged and supported with spline shafts 11 and **11*a* projected on an axial line, as shown in FIG. 3. The right spline shaft 11 is connected to the piston rod 36 of a selecting cylinder CY6 to be slideable in an axial direction. A rod 32 inserted into the center of the other spline shaft 11*a* is connected via a pin 37 to the end of the shaft 11, and a stopper 33 is provided at the other end of the rod. A pinion 34 is engaged with the spline shaft 11*a* in mesh with the rack 35 at the end of a piston rod 38 of an inverting cylinder CY7. Since the segments 8 are engaged with the right spline shaft 11 but avoid the engagement with the left rotary spline shaft 11*a* in the state shown in FIG. 3, any of the segments 8 is not inverted even if the cylinder CY7 is operated. When the shaft 11 is moved rightwardly in the amount corresponding to the predetermined number of sheets, by the stroke control of the selecting cylinder CY6, the corresponding number of segments 8 engage with the shaft 11*a*. When the cylinder CY7 is then operated, the engaged segments 8 are inverted as shown in FIGS. 2 and 7. The attitude of the segments 8 at the normal position before inverting is shown by solid lines in FIG. 4, and the attitude when the inversion is completed is shown by the phantom lines. The right end of the thin segment group is not slid laterally, but becomes a reference line as shown by reference numeral 50** in FIG. 7 and becomes a center when the width of the tool is determined as will be described later.

When the operations of the above respective cylinders are controlled by NC, the work of this type can be automated.

In the embodiment shown in the drawings, a hydraulic column type press is equipped with a wing type bending system avoiding any die marks. Due to the high rigidity of the wing system, accurate formation of components are obtained in a repeatable fashion. The following features are incorporated: Two step regulating unit for the rapid adjustment of two different plate thicknesses, and four step programming unit for different bending angles and back up units to give additional support to the wing and thereby increase rigidity.

Figure 8:
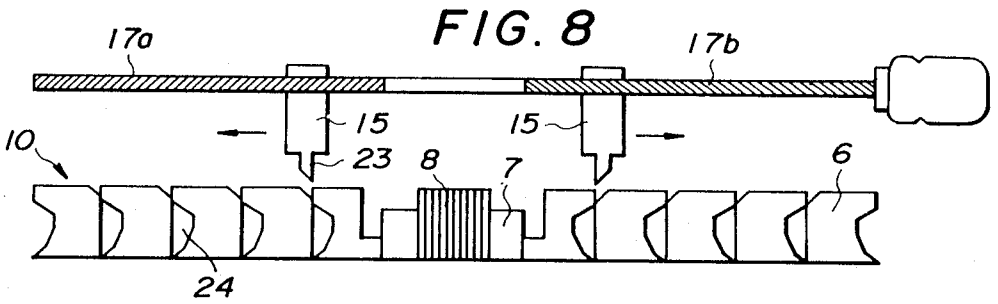
FIGS. 8 to 10 are front schematic views showing the tool length adjusting operation when a sheet metal is bent in the present invention.
Figure 9:
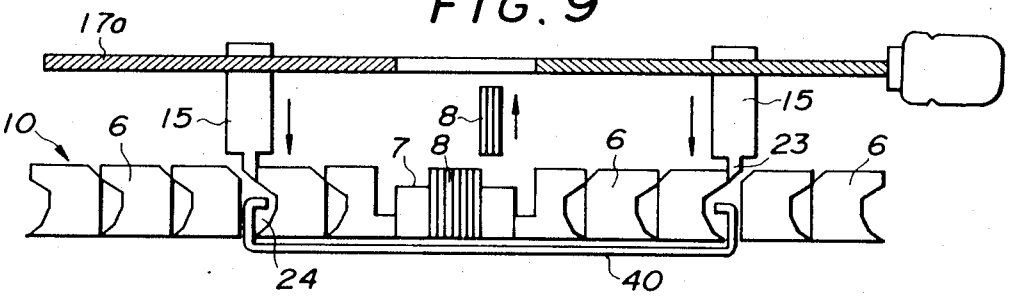
Figure 10:
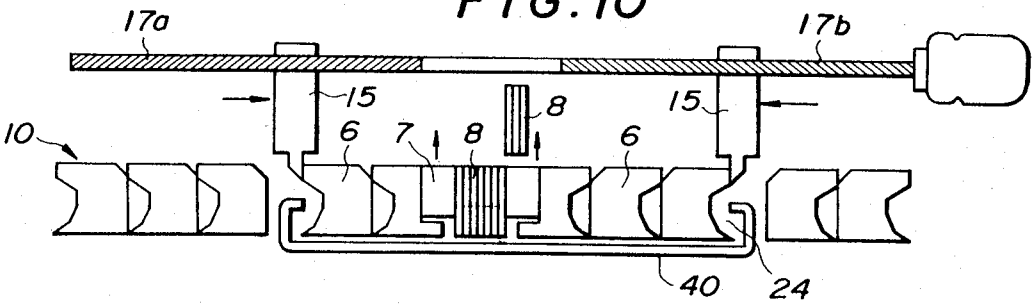

The operation described is one in which the short side of the sheet metal is bent and thereafter the long side of 785 mm in width is bent. The rotary driving mechanism 22 is first driven, such that the right and left screws **17*b* and 17*a* are rotated through the sprocket 21, and the interval of the select fingers 23 and 23 is moved to the position of 800 mm. Subsequently, the cylinder CY6 is operated to move rightwardly three segments 8 from the left side of the thin segment group to move the spline shaft into the same three segments. The spline shaft stops at the distance corresponding to (100-85)mm and at the position moves rightwardly by 10 mm at the connecting seam of the shafts 11 and 11*a* in FIG. 3. In this case, less than 5 mm unit is cut. Then, the cylinders CY3L and CY3R for operating the select finger are operated, and a gap of 10 mm is formed at the right and left sides at 800 mm in width of the segment 6 as shown in FIG. 8. Successively, the rack and pinion 34 and 35 are operated by the inverting cylinder CY7 to rotate the three segments at 180°, the inner side is contracted by the fingers 23 and 23 and shafts 17*a*–17*b* rotated to move the segments 6**, thereby eliminating the interval formed by removal of the three segments. The die is thereby adjusted to the width at 785 mm, as shown in FIG. 9.

Figure 12:
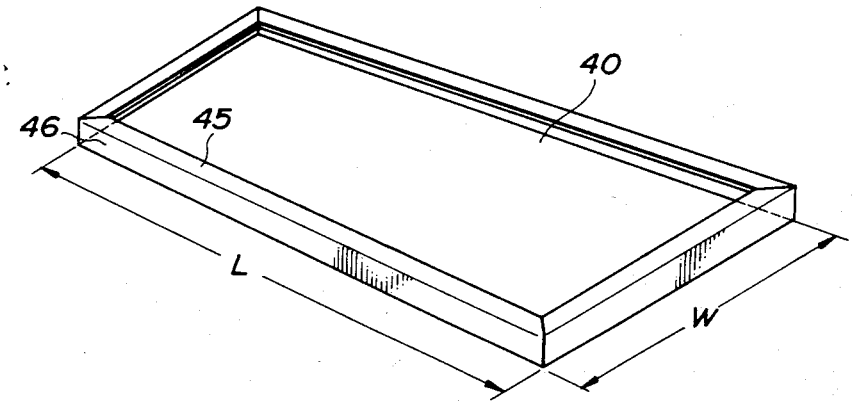
FIG. 12 is a perspective view of a product formed by bending the four sides of the sheet metal in FIG. 11.

In case that the word is bent, the sheet metal 40 is supplied from the right side in FIG. 2, and the end thereof is urged to a contact piece 39 at a back gauge mechanism, thereby setting the bending length (the length of the long side which moves during the bending and is shown by 45 and 46 in FIG. 12).

Figure 11:
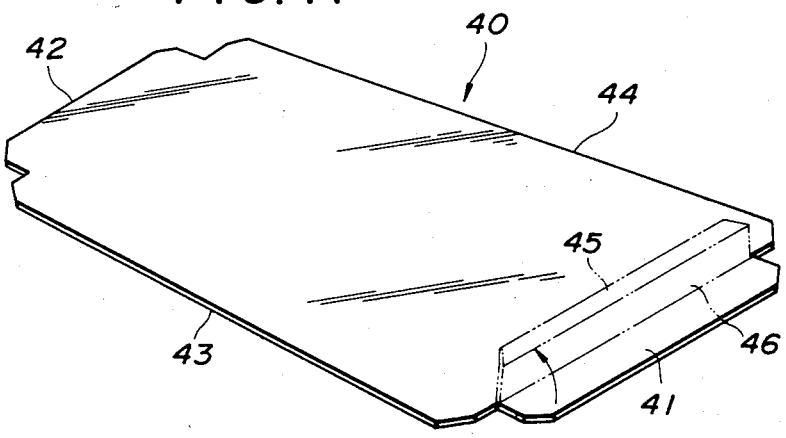
FIG. 11 is a perspective view of a sheet metal used in the present invention.

When the periphery of the work is bent in a U shape, the following steps are ordinarily performed. As shown in FIG. 11, the edge of the one short side 41 of the sheet metal (work) 40 is cut as shown and bent in two steps (at the short side). The work is then turned 180° on a front table (handling table), not shown. The other side 42 of the metal is then bent. The work is turned 90°, and the edge of the one long side 43 is bent. The work is further turned 180°, and the other long side 44 is bent. The result is a product of rectangular shape having a width W and a length L with the four sides bent in a U shape by the first bends 45 and the second bends 46. In the above steps, the entire top tool is raised by approx. 5 mm after the bendings of the respective sides are finished. The right and left adjustable tools 7 and 7 are then positioned by the cylinders CY5L and CY5R to the solid lines positioned in FIG. 7, thereby retracting them. Then, select fingers 23 and 23 are then advanced again by operation of the tool pulling cylinders CY1R and CY1L, thereby contracting the entire tool at 300 mm at both right and left sides. The movement is permitted by the recess formed by the retracted top tools 7, as shown in FIG. 11. The bent edge of the short sides can be smoothly removed without interfering with both top tool segments due to this retraction of the tool. After the work is removed, the segments are displaced to the center by the operations of the cylinders CY4L and CY4R, the segments 7 and 7 are advanced by the cylinders CY5L and CY5R at 785 mm for preparing to the next step.

According to the present invention as described above, the top tool is formed in tool segments, with the top thin tool segments to provide an adjustable tool, which can be retracted. Accordingly, the sheet metal which has the sides bent in the U shape can be readily removed from the forming tool. To alter the width of the tool, the select fingers, and the inverting mechanism are positioned by operating the various cylinders, thereby automating the operation. Therefore, the work can be remarkably efficiently bent.

What is claimed is:

1. A tool length exchanging device in a forming machine for bending the edge of a metal sheet comprising:

a ram (4) having a lower end, a top tool body (5) mounted on the lower end of said ram (4), a bottom tool (2) mounted below the top tool body (5), a top tool including a group of top tool segments (6) slideable in a transverse direction of said top tool at the lower end of said body (5), a number of thin top tool segments (8) invertably mounted at the center of said group of said top tool segments (6), each of said thin top tool segments having a thin width substantially less than each of said top tool segments, a movable tool (3) rotating at 90° around both of said top tool and said bottom tool (1, 2) and said top and bottom tools retaining the metal sheet (40), a sheet finger driving mechanism (14) provided at the front of said body (5) to slide said top tool segments (6) in said transverse direction of the tool, and an inverting mechanism (32, 34, 35, Cy 7) provided at the rear side of said top tool body (5) to invert a predetermined number of said thin top tool segments (8) in a direction other than said transverse direction.

2. The device according to claim 1, wherein said inverting mechanism comprises a first spline shaft slidable by a selecting cylinder for inserting and engaging a number of said thin top tool segments and a second spline shaft provided oppositedly to said first spline shaft for inverting rotation for engaging and invertingly rotating only the group of the thin top tool segments selected by the operation of the selecting cylinder.

3. The device according to claim 1, wherein each of said top tool segments adjacent to both sides of said group of said thin top tool segments includes a recess formed on the back surface, a top adjustable tool movable into and from the recess for adjusting the width of the segments by telescoping the top adjustable tool with respect to the recess.

4. The device according to claim 1, wherein said top tool segment is formed with an oblique surface so as to prevent interference with a bend of said sheet metal at the right or left side thereof.

5. The device according to claim 1, wherein said select finger driving mechanism comprises a screw rod mounted laterally of said body, a select finger engaged with said rod, and a segment selecting cylinder provided at the end of said rod.

6. The device according to claim 1, wherein said forming machine is a wing bender having said movable tool rotating at 90° around the stationary end of both said top and bottom tools as a rotating center and retaining the edge of said sheet metal with said top and bottom tools.

* * * * *

UNITED STATES PATENT AND TRADEMARK OFFICE

CERTIFICATE OF CORRECTION

PATENT NO. : 4,532,792

DATED : August 6, 1985

INVENTOR(S) : TOSHIO HONGO

It is certified that error appears in the above-identified patent and that said Letters Patent is hereby corrected as shown below:

Col. 5, line 44 cancel "word" and substitute therefor ---work---

Col. 6, line 42 after "a" cancel "sheet"and substitute therefor ---select---

Signed and Sealed this

*Third* Day of *December 1985*

[SEAL]

*Attest:*

DONALD J. QUIGG

*Attesting Officer*

*Commissioner of Patents and Trademarks*